US006329960B1

(12) United States Patent
Andrew et al.

(10) Patent No.: US 6,329,960 B1
(45) Date of Patent: Dec. 11, 2001

(54) ANTENNA ASSEMBLY

(75) Inventors: Rodger J Andrew, Wimborne; Stephen A Williams, Southampton, both of (GB)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/657,133

(22) Filed: Sep. 7, 2000

(30) Foreign Application Priority Data

Jun. 24, 2000 (GB) ..... 0015398

(51) Int. Cl.[7] ..... H01Q 1/48

(52) U.S. Cl. ..... 343/846; 343/700 MS; 343/702

(58) Field of Search ..... 343/700 MS, 702, 343/846, 848

(56) References Cited

U.S. PATENT DOCUMENTS 5,537,123 7/1996 Mandai et al. ..... 343/700 MS
6,034,636 * 3/2000 Saitoh ..... 343/700 MS
6,184,834 * 2/2001 Utsumi et al. ..... 343/702
6,195,048 * 2/2001 Chiba et al. ..... 343/700 MS

* cited by examiner

*Primary Examiner*—Tan Ho
(74) *Attorney, Agent, or Firm*—Nixon & Vanderhye P.C.

(57) ABSTRACT

An antenna assembly comprises a printed circuit board having on one face various components and on the other face a ground plane, and a planar F suspended antenna comprising a conductive ground plane element having peripheral parts overlapping the edge of an aperture in the board a connecting element extending from the ground plane element through the aperture, a radiator element integral with the connecting element and extending generally parallel and within the area of the ground plane element, and an antenna feed element which extends from the radiating element though the aperture.

14 Claims, 1 Drawing Sheet

ANTENNA ASSEMBLY

FIELD OF THE INVENTION

This invention relates to an antenna assembly suitable for a communication device such as a mobile transceiver, a mobile telephone, a device for providing radio communication to and from a personal computer, a wireless base station and so on. More particularly the invention relates to an antenna which is particularly adapted for insertion in a printed circuit board which carries at least some of the components for the communication device.

BACKGROUND OF THE INVENTION

A known form of antenna which may be employed in communication devices of the foregoing character is a planar suspended F antenna, which comprises a radiating element, typically a planar sheet, mounted above and extending partly over a ground plane, the radiating element being connected to the ground plane along one edge. A conductive antenna feed couples signals to or from the antenna and the operating circuits of the communication device the antenna feed is normally connected to the radiating element at a position substantially separated from the grounded edge thereof, typically at a location part of the way along the radiating element and at one edge thereof. The radiating element requires a continuous ground plane underneath it and according there should be no components of the aforesaid operating circuits located close to the radiating element.

It is desirable for the minimization of cost in product manufacturing to employ single sided printed circuit boards. Since a planar suspended F-type antenna requires significant space around it to be free from components, and having regard to the desirability of economising as far as possible in the occupancy of the area available on a printed circuit board, it is known to form the antenna with extending legs which are placed on the non-component side of the printed circuit board. Such a structure is difficult to place automatically and commonly it has to be placed and soldered in circuit by hand.

SUMMARY OF THE INVENTION

The invention particularly concerns an antenna assembly comprising a printed circuit board having on one face various components and on the other face a ground plane, said printed circuit board including an aperture and an antenna structure comprising a conductive ground plane element having peripheral parts overlapping the edge of the aperture, a connecting element extending from the ground plane member through the said aperture, a radiator element integral with the connecting element and extending generally parallel and within the area of the ground plane element, and an antenna feed element which extends from the radiating element though said aperture to said one face of the printed circuit board.

The antenna structure may be readily made from a single sheet of appropriate conductive material. It may be formed into the required shape by cutting and bending and may readily be inserted with the aid of an automatic insertion tool, through the aperture in the printed circuit board from the component side thereof until the peripheral parts engage the component bearing face of the printed circuit board. Automatic soldering is easy to perform on the component side of the printed circuit board both to secure the ground plane element in position and to provide the necessary conductive connection for the antenna feed.

A specific example of the invention will be described hereinafter with reference to the accompanying drawings.

DESCRIPTION OF A SPECIFIC EXAMPLE

Figure 1:
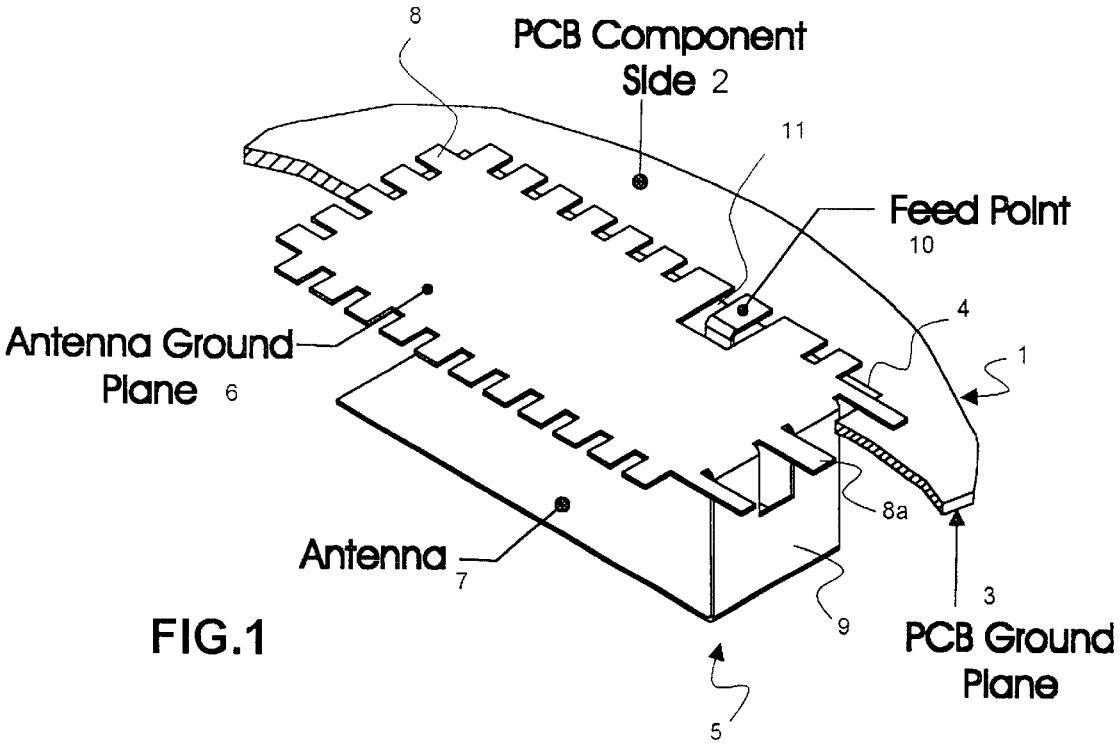
FIG. 1 is a perspective view of an antenna assembly according to the invention.
Figure 2:
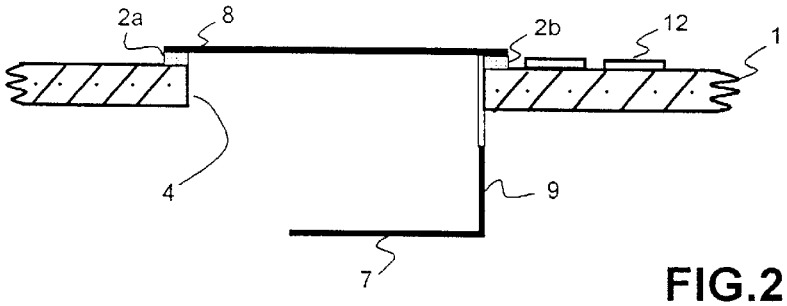
FIG. 2 is a sectional view of the centre line of the antenna structure shown in FIG. 1.

In the assembly shown in the drawings, there is a generally planar printed circuit board 1 which has an 'upper' face 2 and a lower 3. The printed circuit board is a single sided board in which the various electrical components, either discrete components, individual integrated circuits and conductive paths and so on are disposed only on one face, in this example the upper face 2 of the printed circuit board. The lower face 3 of the board is covered with a conductive layer to constitute a ground plane for the printed circuit board.

For the accommodation of a planar suspended F antenna, the printed circuit board is provided with a rectangular aperture 4 through which an antenna structure 5 may be automatically inserted from the component side of the printed circuit board. The aperture 4 is a 'though-plated' aperture which connects the pads on the 'upper' face of the printed circuit board to the ground plane on the lower face so ensuring the integrity of the ground plane. The antenna structure 5 comprises an integral member having four principal parts. These parts include a ground plane 6 constituted by a generally flat element. Spaced from and generally (though not necessarily exactly) parallel to the ground plane 6 is a planar radiator element 7 which is preferably somewhat less than coextensive with the ground plane 6 and is preferably within the area defined by the ground plane 6.

The ground plane 6 is crenellate around its edges, so as to form a multiplicity of attachment lugs 8 which overlap the margin of the aperture 4 and are soldered to underlying pads 2*a*, 2*b* etc on the upper surface of the board 1. Connecting the planar element 6 and the radiator element 7 is a connecting part 9 which preferably forms a join with the antenna element along a mutual margin of the element 6 and connecting part 9 and has a common edge with the ground plane member 6. The lug 8*a* which extends from the common edge of part 9 and planar element 6 may be cut out from the aperture in the part 9.

Also integral with the antenna structure is an antenna feed 10 which extends from a location preferably adjacent a side edge of the radiator element to the plane of the ground plane element, having an end lug which is disposed inside a peripheral aperture or slot 11 in the ground plane element so that the feed does not connect with the ground plane except by way of the radiator element.

The structure may be inserted into the aperture from the component side of the board 1 so that the lugs 8 engage the pads on the upper surface of the printed circuit board and the connecting element 9 abuts one side of the aperture. The lugs 8 may be reflow soldered into position by an appropriate automatic soldering tool.

What is claimed is:

1. An antenna assembly comprising a printed circuit board having on one face various electrical components and on the other face a ground plane, said printed circuit board including an aperture, and an antenna structure comprising:

a conductive ground plane element having peripheral attachment lugs overlapping the edge of the aperture, a connecting element integral with the ground plane element and extending from the ground plane element through the said aperture, a radiator element integral with the connecting element and extending generally parallel and within the area of the ground plane element, and an antenna feed element which extends from the radiator element through said aperture to said one face of the printed circuit board.

2. An antenna assembly as in claim 1 wherein said antenna structure is constituted by a single sheet of conductive material.

3. An antenna assembly as in claim 2 wherein the ground plane element is crenellate around its edges whereby to form a multiplicity of lugs which overlap the margin of the aperture.

4. An antenna assembly as in claim 3 wherein the lugs are soldered to underlying pads on the said one face of the board.

5. An antenna assembly as in claim 4 wherein the feed element extends from a location adjacent a side edge of the radiator element to the plane of the ground plane element, having an end lug disposed inside a peripheral slot in the ground plane element.

6. An antenna assembly as in claim 1 wherein the ground plane element is crenellate around its edges whereby to form a multiplicity of lugs which overlap the margin of the aperture.

7. An antenna assembly as in claim 6 wherein the lugs are soldered to underlying pads on the said one face of the board.

8. An antenna assembly as in claim 6 wherein the feed element extends from a location adjacent a side edge of the radiator element to the plane of the ground plane element, having an end lug disposed inside a peripheral slot in the ground plane element.

9. An antenna assembly comprising a printed circuit board having on one face various electrical components and on the other face a ground plane, said printed circuit board including an aperture, and an antenna structure comprising:

a conductive ground plane element having peripheral parts overlapping the edge of the aperture, a connecting element extending from tie ground plane element through the said aperture, a radiator element integral with the connecting element and extending generally parallel and within the area of the ground plane element, and an antenna feed element which extends from the radiator element through said aperture to said one face of the printed circuit board;

said antenna structure being constituted by a single sheet of conductive material; and said ground plane element being crenellate around its edges to form a multiplicity of lugs which overlap the margin of the aperture.

10. An antenna assembly comprising a printed circuit board having on one face electrical components and on the other face a ground plane, said printed circuit board including an aperture and an antenna structure mounted therewithin comprising:

a metallic ground plane continuation portion electrically connected to said ground plane of the printed circuit board and spatially juxtaposed parallel thereto;

a planar metallic radiator portion disposed parallel to and opposite said ground plane continuation portion; and a metallic interconnecting portion that is substantially orthogonal with respect to the other said portions of the antenna structure.

11. An antenna assembly as in claim 10 wherein all said metallic portions of the antenna structure are integrally formed from one piece of metal.

12. An antenna assembly as in claim 10 wherein said metallic ground plane continuation portion is crenellate around at least some of its edges to form a multiplicity of lugs which overlap respective edges of the aperture.

13. An antenna assembly as in claim 12 wherein said lugs are soldered to underlying connection pads located on the component side of the printed circuit board but through-connected to the ground plane side of the printed circuit board.

14. An antenna assembly as in claim 12 wherein a feed element extends from a side edge of the aperture towards said radiator portion.

* * * * *